US011156417B2

(12) United States Patent
Venaille et al.

(10) Patent No.: US 11,156,417 B2
(45) Date of Patent: Oct. 26, 2021

(54) CAP FOR DUCT FOR EJECTING CARTRIDGES AND TURRET INCLUDING A DUCT FOR EJECTING CARTRIDGES OBTURATED BY SUCH A CAP

(71) Applicant: NEXTER SYSTEMS, Roanne (FR)

(72) Inventors: Vincent Venaille, Bourges (FR); Michel Brun, Bourges (FR)

(73) Assignee: NEXTER SYSTEMS, Roanne (FR)

( * ) Notice: Subject to any disclaimer, the term of this patent is extended or adjusted under 35 U.S.C. 154(b) by 0 days.

(21) Appl. No.: 16/483,151

(22) PCT Filed: Jan. 26, 2018

(86) PCT No.: PCT/FR2018/050181
§ 371 (c)(1),
(2) Date: Aug. 2, 2019

(87) PCT Pub. No.: WO2018/142047
PCT Pub. Date: Aug. 9, 2018

(65) Prior Publication Data

US 2020/0232735 A1 Jul. 23, 2020

(30) Foreign Application Priority Data

Feb. 2, 2017 (FR) ..... 1700122

(51) Int. Cl.
*F41H 7/03* (2006.01)
*F41A 9/54* (2006.01)
(Continued)

(52) U.S. Cl.
CPC ..... *F41A 9/54* (2013.01); *F41H 5/20* (2013.01); *F41A 9/60* (2013.01); *F41A 15/00* (2013.01); *F41A 35/02* (2013.01); *F41H 7/03* (2013.01)

(58) Field of Classification Search
CPC ... F41F 3/07; F41F 3/073; F41F 3/077; F41A 21/46; F41A 35/02; F41A 35/04; F41H 7/03
See application file for complete search history.

(56) References Cited

U.S. PATENT DOCUMENTS 44,631 A * 10/1864 Hull ..... F41A 13/04 89/5
45,020 A * 11/1864 Cleu ..... F41A 35/04 89/31
(Continued)

FOREIGN PATENT DOCUMENTS

| | | |
|---|---|---|
| DE | 571 197 C | 2/1933 |
| EP | 1 468 240 B1 | 4/2010 |
| FR | 3 005 155 A1 | 10/2014 |

OTHER PUBLICATIONS

Nov. 21, 2017 Preliminary Search Report issued in French Patent Application No. 1700122.
(Continued)

*Primary Examiner* — Derrick R Morgan
(74) *Attorney, Agent, or Firm* — Oliff PLC

(57) ABSTRACT

A cap that is intended to obturate a duct for ejecting cartridges of a turret. This cap includes a circular base that is intended to allow it to be fastened to the duct, and a body shell having a spherical dome profile including a concave face and a convex face, the body shell being divided into at least four sectors by radial slits that are regularly distributed angularly, the sectors being contiguous pairwise. Another subject of the invention is a turret including a duct for ejecting cartridges equipped with such a cap.

13 Claims, 7 Drawing Sheets

(51) Int. Cl.

| | |
|---|---|
| ***F41H 5/20*** | (2006.01) |
| *F41A 9/60* | (2006.01) |
| *F41A 15/00* | (2006.01) |
| *F41A 35/02* | (2006.01) |

(56) References Cited

U.S. PATENT DOCUMENTS 587,731 A * 8/1897 Hammer ..... F41A 35/04 89/31
1,258,283 A * 3/1918 Weyand ..... F41A 35/04 42/96
2,622,762 A * 12/1952 Parsons ..... B60K 15/0406 220/203.11
2,906,175 A * 9/1959 Mohaupt ..... F41A 35/04 89/1.1
3,005,573 A * 10/1961 Dawson ..... F16K 17/162 220/89.2
3,176,712 A * 4/1965 Ramsden ..... F16K 15/144 137/496
3,257,026 A * 6/1966 Taylor ..... F16K 17/162 220/89.2
3,422,844 A * 1/1969 Grise ..... F16K 15/147 137/847
3,628,565 A * 12/1971 McWethy ..... F16K 15/144 137/855
3,677,132 A * 7/1972 Plenge ..... F41A 35/02 89/14.2
3,762,279 A * 10/1973 Zeyher ..... F41A 1/08 92/85 R
3,797,522 A * 3/1974 Carleton ..... F16K 15/141 137/528
4,301,708 A * 11/1981 Mussey ..... F41F 3/077 89/1.81
4,498,368 A * 2/1985 Doane ..... H01Q 15/142 220/89.2
4,733,596 A * 3/1988 Crow, III ..... F42B 39/28 206/3
4,892,051 A * 1/1990 Taylor ..... B63G 1/00 114/1
5,042,743 A * 8/1991 Carney ..... F41G 7/303 244/3.11
5,046,276 A * 9/1991 Morris ..... F41A 17/00 42/70.01
5,062,345 A * 11/1991 Tegel ..... F41F 3/077 89/1.817
6,311,604 B1 * 11/2001 Foris ..... F41F 3/077 89/1.817
6,378,544 B1 * 4/2002 DiBello ..... F16K 17/16 137/68.25
6,427,574 B1 * 8/2002 Callahan ..... F41F 3/07 89/1.81
7,021,189 B2 4/2006 Patry et al.
7,086,318 B1 * 8/2006 Darnall ..... F41A 23/42 89/1.815
7,506,572 B1 * 3/2009 Hombeck ..... F41F 3/07 89/1.81
7,520,204 B2 * 4/2009 Williams ..... F41F 3/077 220/200
7,954,412 B2 * 6/2011 Jansson ..... F41F 3/077 89/1.817
8,776,771 B1 * 7/2014 Yang ..... F42B 12/80 124/71
10,100,942 B2 * 10/2018 Pittel ..... F16K 17/40
10,429,258 B1 * 10/2019 Bartyczak ..... G01L 1/2218
2005/0183321 A1 * 8/2005 Brown ..... F41F 3/077 42/96
2010/0281728 A1 * 11/2010 Fu ..... F41A 21/32 42/1.14
2011/0000122 A1 * 1/2011 Camarillo ..... F41A 35/04 42/96
2014/0238373 A1 * 8/2014 Yang ..... F41A 35/00 124/83
2017/0138699 A1 * 5/2017 Rondeux ..... H04N 5/2328

OTHER PUBLICATIONS

Nov. 17, 2017 Written Opinion issued in French Patent Application No. 1700122.

May 7, 2018 Search Report issued in International Patent Application No. PCT/FR2018/050181.

May 7, 2018 Written Opinon of the International Searching Authority issued in International Patent Application No. PCT/FR2018/050181.

* cited by examiner

CAP FOR DUCT FOR EJECTING CARTRIDGES AND TURRET INCLUDING A DUCT FOR EJECTING CARTRIDGES OBTURATED BY SUCH A CAP

The technical field of the invention is that of the caps intended to obturate a duct for ejecting cartridges from a turret, as well as that of turrets equipped with such caps.

Patent EP1468240 describes a turret comprising a hole for ejecting cartridges from a weapon. The hole is obturated by a membrane or a cap which includes lips that move away from each other when the cartridges pass and that become again contiguous after the cartridge has passed. More precisely, the cap has a cup-shaped profile with a substantially flat bottom.

The turret is under over-pressure in comparison to the outside, so as to ensure a sealing and a protection when the vehicle moves in an environment contaminated by nuclear, bacteriological or chemical pollutants.

Such a cap is sized so as to remain obturated despite the over-pressure within the turret. It results in a stiffness of the cap which impedes the ejection of cartridges.

The invention aims to propose a cap allowing to ensure a sealing level that is better than the known caps, and a reduced resistance to the ejection of cartridges.

The invention also relates to a turret equipped with at least one such cap.

Thus, the invention relates to a cap intended to obturate a duct for ejecting cartridges from a turret, the cap being characterized in that it comprises a circular base intended to allow it to be attached at the duct, and a shell having a spherical dome profile including a concave face and a convex face, the shell being divided into at least four sectors by slots which are evenly distributed angularly, the sectors being contiguous pairwise.

According to a particular embodiment, the shell could include a thinner area at the vicinity of its axial part.

This thinner area could result from the presence of a land.

The thinner area could result from the presence of a different radius of curvature among a peripheral part and a median part at the concave face and/or the convex face of the shell.

According to a particular embodiment, the shell could comprise a thickness-decreasing circular area which is located at the vicinity of the base of the sectors.

Advantageously, the shell could have a substantially hemispherical shape.

According to another embodiment, each slot could be inclined with respect to a diametrical plane, the inclination being variable between the base of the slot and its end at the vicinity of the axis of the cap, the slot being diametrically oriented at the vicinity of the axis of the cap so as to ensure the contact of the plural sectors, the inclination of the slots ensuring a partial covering of the contiguous sectors.

The cap will advantageously be made of rubber.

The invention also relates to a turret comprising a duct for ejecting cartridges between an area inside the turret and the outside, the turret being characterized in that the duct includes at least one cap according to the invention, through which cap the cartridges pass when they are ejected.

The turret could include a cap that is oriented with its convex face towards the inside area.

The turret could include a cap that is oriented with its convex face towards the outside.

The invention will become more apparent upon reading the following description of various embodiments, made in reference to the appended drawings in which:

FIGS. 1*a* and 1*b* are two views of a first embodiment of a cap according to the invention, FIG. 1*a* being a longitudinal sectional view along the plane AA whose trace is visible in FIG. 1*b*, and FIG. 1*b* being a front view;

FIGS. 2*a* and 2*b* are two views of a second embodiment of a cap according to the invention, FIG. 2*a* being a longitudinal sectional view along the plane BB whose trace is visible in FIG. 2*b*, and FIG. 2*b* being a front view;

Figure 7B:
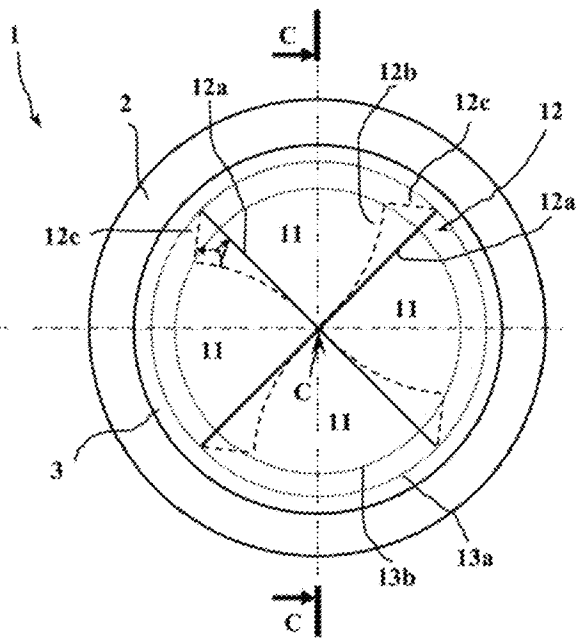
Figure 7A:
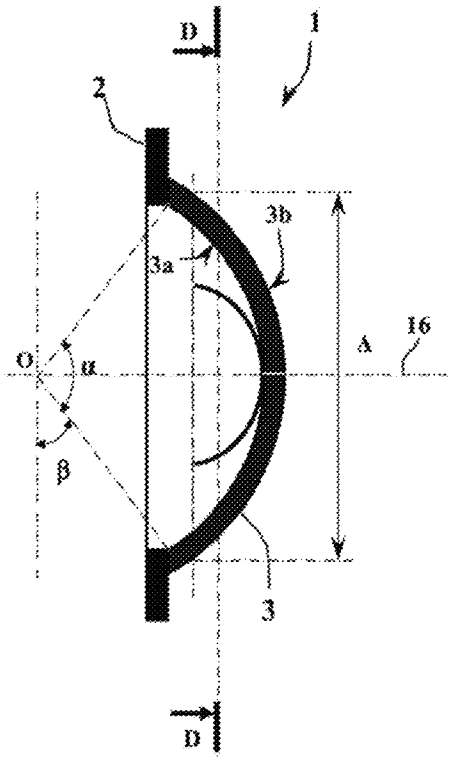
Figure 8:
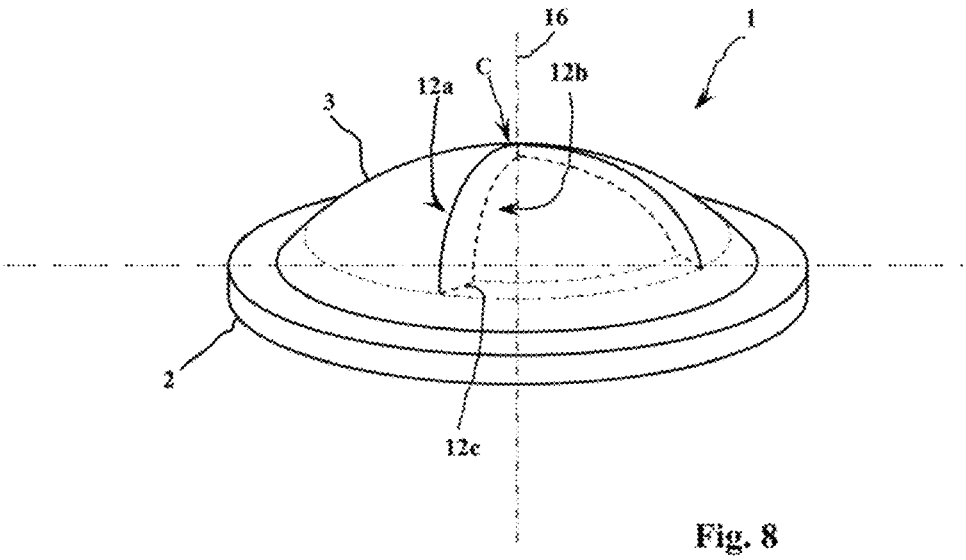
Figure 9:
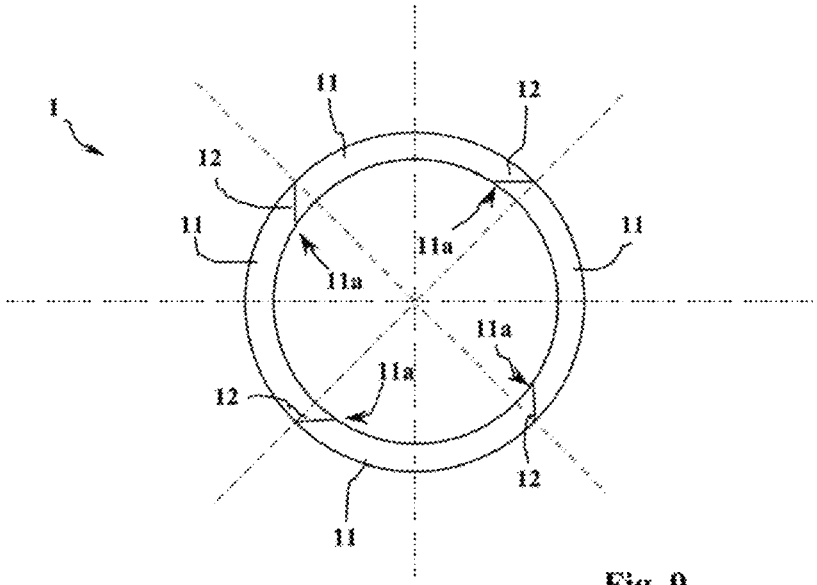

FIGS. 7*a* and 7*b* are two views of a fifth embodiment of a cap according to the invention, FIG. 7*a* being a longitudinal sectional view along the plane CC whose trace is visible in FIG. 7*b*, and FIG. 7*b* being a front view;

FIG. 8 is a perspective view of the cap according to this fifth embodiment;

FIG. 9 is a sectional view of the dome along the plane whose trace DD is visible in FIG. 7*a;*

Figure 10:
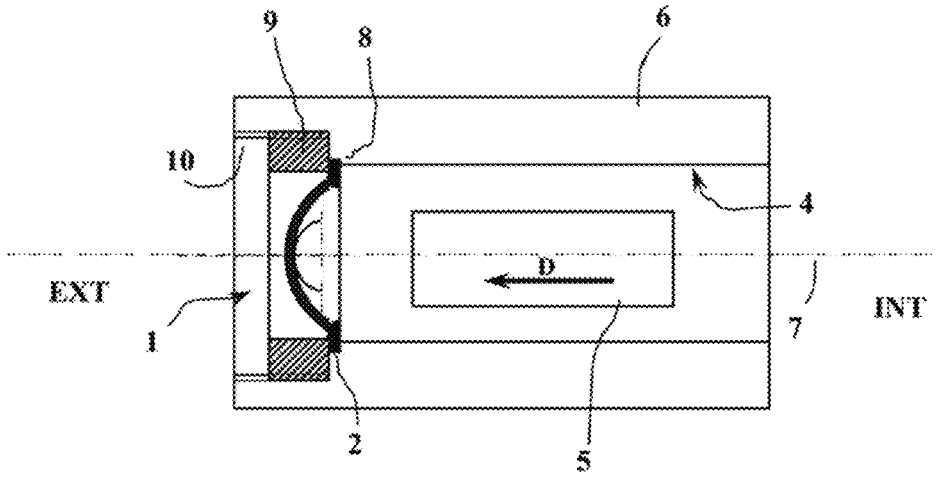
Figure 11:
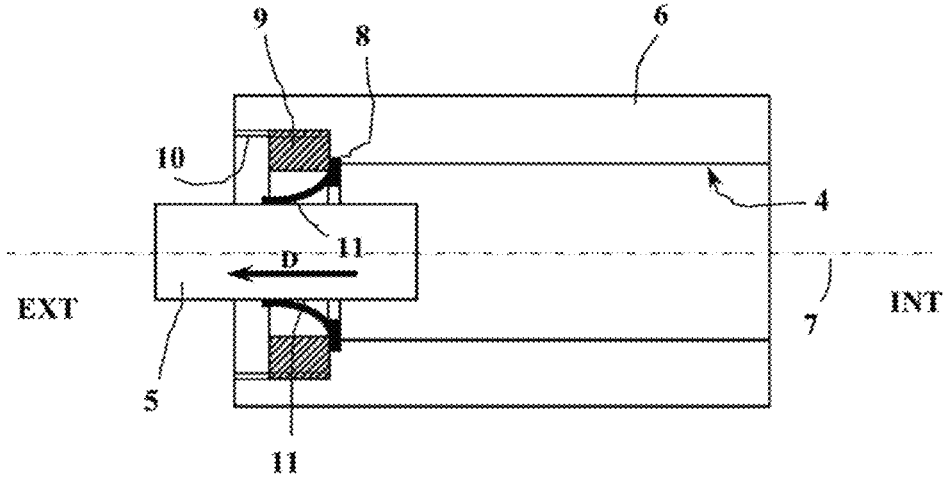

FIG. 10 is a schematical view of a duct for ejecting cartridges from a turret according to another embodiment of the invention, a cartridge being positioned in front of the cap;

FIG. 11 is a schematical view of the same duct in which a cartridge passes through the cap;

FIGS. 12*a*-12*d* show, in a longitudinal sectional view, different variants of a cap according to the invention.

Figure 1A:
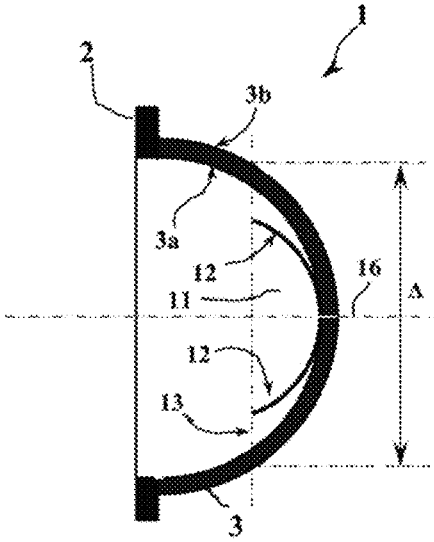
Figure 1B:
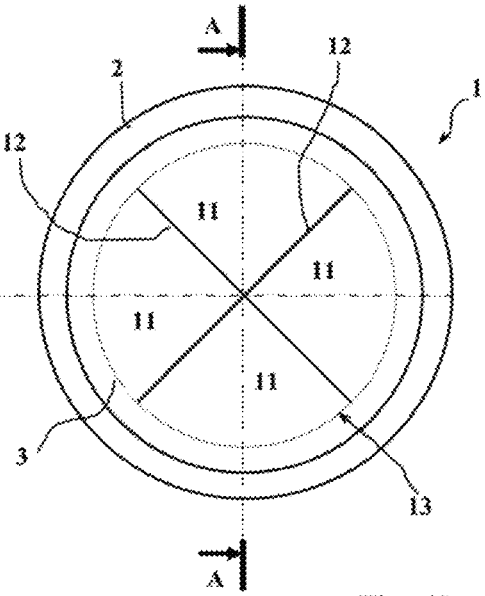

In reference to FIGS. 1*a* and 1*b*, a cap 1 according to a first embodiment of the invention comprises a circular base 2 and a shell 3 which comprises a concave face 3*a* and a convex face 3*b*. The shell 3 has a spherical dome profile and more particularly here a substantially hemispherical dome shape.

Figure 5:
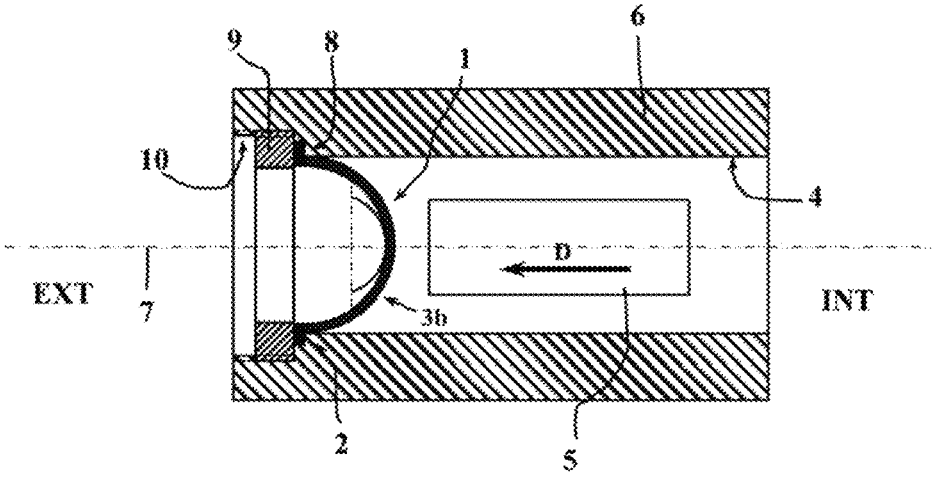
FIG. 5 is a schematical view of a duct for ejecting cartridges from a turret according to the invention, a cartridge being positioned in front of the cap.

As it can be seen in FIG. 5, the cap 1 is intended to be attached at a duct 4 for ejecting cartridges 5 from a turret 6. The turret is not shown in detail, FIG. 5 showing only one part of the duct 4.

Conventionally, the ejecting duct 4 makes it possible to move the cartridges 5 from an area (INT) inside the turret to the outside (EXT).

A weapon system, which is not shown, is provided on the inside INT side and pushes the cartridges 5 in the duct 4. The cartridges 5 are ejected along the direction D that is parallel to the axis 7 of the duct 4.

According to the embodiment shown in FIG. 5, the circular base 2 of the cap 1 abuts against a shoulder 8 surrounding the duct 4 and is immobilized by a nut 9 screwed in a tapped hole 10.

This mode for attaching the cap 1 on the duct 4 is provided as an example. Other attaching modes would of course be possible, for example a series of perforations made in the circular base 2, and which will be positioned in front of tapped holes provided in the shoulder 8. In such a case, a toroidal washer with a rectangular cross-section, also provided with perforations, will replace the nut 9 in order to receive a set of tightening screws making it possible to press it on the circular base 2 so as to pinch it against the shoulder 8.

Again, in reference to FIGS. 1*a* and 1*b*, it can be noted that the shell 3 is divided into at least four sectors 11 (here, four sectors 11) by diametrical slots 12 (here, two slots) which are evenly distributed angularly, the sectors 11 being contiguous pairwise.

The cap 1 is made of a flexible material such as rubber. The natural elasticity of the material ensures that the cap 1 is held in closed position as visible in FIGS. 1*a* and 1*b*. Furthermore, the shape of the shell with a spherical profile ensures that the cap returns in an obturated position after it has been deformed by a cartridge, and thus ensures a good sealing while maintaining its ability to deform. In the closed position according to FIGS. 1*a* and 1*b*, the sealing of the duct 4 is thus ensured.

Furthermore, when the cap 1 is mounted with being oriented with its convex face 3*b* towards the inside area INT, as visible in FIG. 5, the over-pressure within the turret holds the sectors 11 against each other, thus in a position increasing the sealing.

Figure 6:
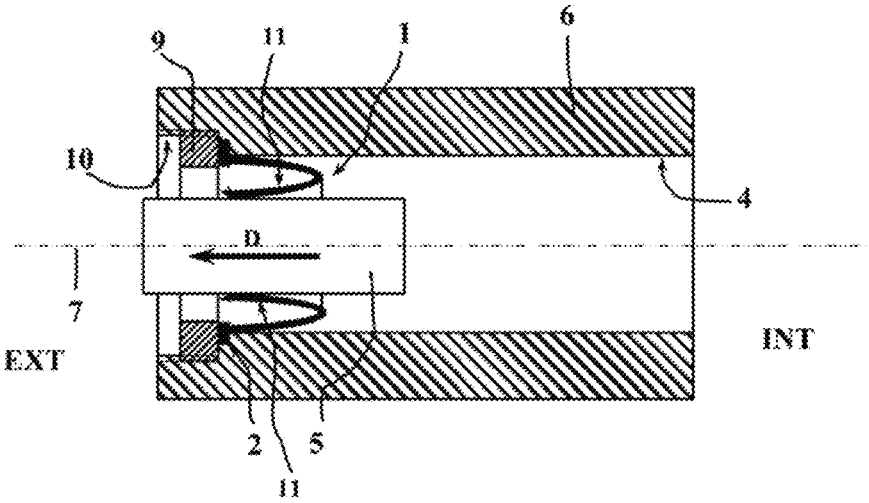
FIG. 6 is a schematical view of the same duct in which a cartridge passes through the cap according to the invention.

As it can be seen in FIG. 6, the cartridge 5, which has an ejection speed of about several meters per second, applies a force at the top of the convex part 3*b* of the cap 3. It causes the sectors 11 to fold towards the interior of the concave part 3*a*. The cartridge 5 can thus pass through the cap 3 and is ejected to the outside EXT of the turret 6.

To make the passage of the cartridge 5 through the cap 3 possible, it is necessary that the slots 12 which delimit the sectors 11 have a length sufficient to allow a sufficient deformation of the cap 3, the fold of the sectors 11 and the passage of the cartridge 5.

In particular, it is necessary that the diameter Δ of the circle 13 (FIG. 1*b*), which is the trace of the plane perpendicular to the axis 16 of the cap passing through the ends of the slots 12, be greater than the diameter of the cartridge 5.

Concretely, to ensure that the friction between the cartridge 5 and the sectors 11 is not excessive, a diameter Δ which is greater by about 70% than the diameter of the cartridge will be selected.

The elasticity of the cap 1, associated with the spherical shape, causes the sectors 11 to return to their initial position (FIG. 1*a*) after the passage of the cartridge 5. Thus, the sealing is ensured after the passage of the cartridge 5. The stiffness of the sectors 11 could be adjusted, for example by changing the number of sectors. For example, three diametrical slots 12, which will delimit six sectors, could be provided.

The stiffness of the sectors 11 and the sealing quality are also linked to the thickness of the cap 1. A cap 1 made of rubber having a thickness of about 3-5 millimeters, for an outer diameter of the cap of about 80-100 millimeters, could be selected.

Figure 2A:
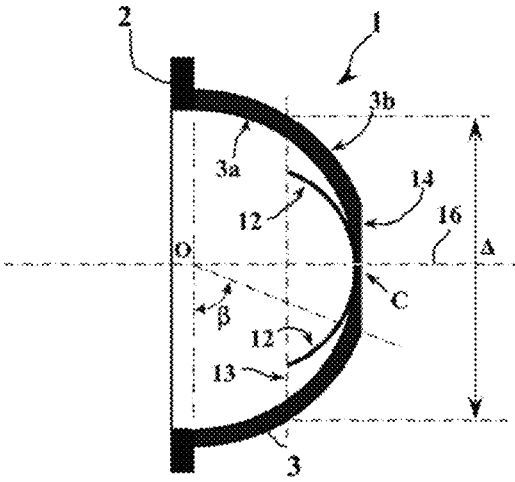
Figure 2B:
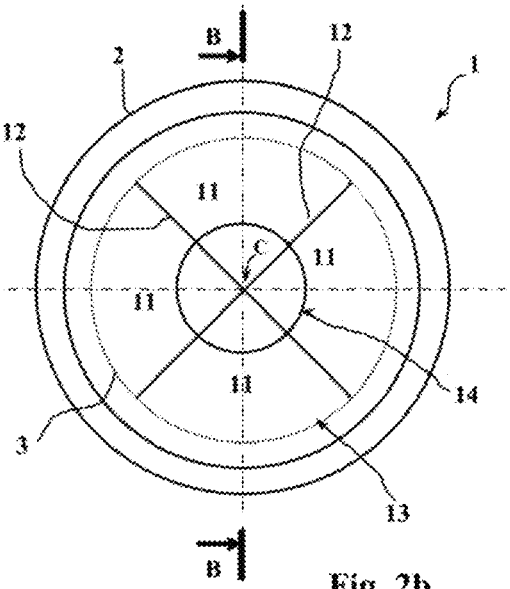

FIGS. 2*a* and 2*b* show a second embodiment of a cap 1 according to the invention.

This cap differs from the preceding one in that a land (flat section) 14 is provided at the top of the convex part 3*b* of the shell 3. The position of this land is defined by the angle with a latitude β with respect to the spherical convex profile 3*b* of the shell 3. The point O in the figure represents the center of this spherical profile. The latitude β, at which the land 14 is located, is about 70°, thereby ensuring a minimum thickness of 1 millimeter at the top of the shell 3, for a shell having a thickness of about 4 mm.

Thus, the thickness of the sectors 11 is gradually reduced between the beginning of the land (latitude 70°) and the center C of the land (latitude 90°).

It results in a controlled location of the beginning of the opening of the cap at the land 14. Furthermore, the sectors 11 have an end tip with a reduced thickness, thereby also reducing the friction applied on the cartridge 5 when it is ejected.

It is also possible to gradually reduce the thickness of the shell 3 at its top using other means.

Figure 3:
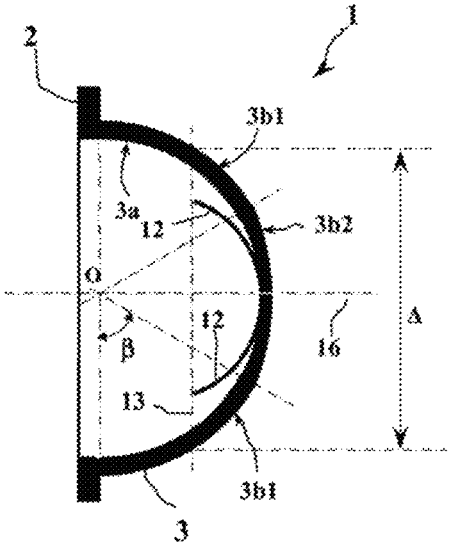
FIG. 3 is a longitudinal sectional view of a cap according to a third embodiment.

Thus, FIG. 3 shows a third embodiment of the cap 1 in which the outer hemispherical profile 3*b* comprises a peripheral part 3*b*1, whose center O coincides with that of the concave part 3*a*, and a median part 3*b*2 whose radius of curvature is greater than that of the peripheral part 3*b*1. It results in a thickness of the shell 3 that is constant in the part 3*b*1 and is variable in the part 3*b*2.

The median part 3*b*2 begins at a latitude β of about 60°. This embodiment allows to provide a decrease in the thickness of the sectors 11 that is more gradual than that obtained with the land.

As a variant, it is possible to provide a median part with a smaller radius of curvature at the concave part 3*a*. Such an arrangement allows to reduce the thickness of the shell 3 from the inside.

Finally, it is possible to combine a median part having a lower radius of curvature and provided at the concave part 3*a*, and a median part that has a greater radius of curvature and is carried by the convex part.

Figure 4:
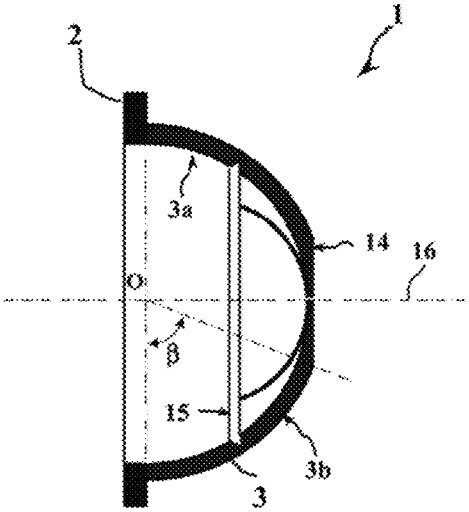
FIG. 4 is a longitudinal sectional view of a cap according to a fourth embodiment.

FIG. 4 shows a fourth embodiment of the invention, in which the cap 1 comprises, at its shell 3, a thickness decreasing area 15 provided on the concave surface 3*a*, at the plane of the circle 13 passing through the ends of the slots 12, thus at the vicinity of the base of the sectors 11.

Such an arrangement makes it possible to facilitate a large folding of the sectors 11 at their base.

This decrease in thickness is provided as a circular notch with a V- or U-shaped profile. It is made at the concave surface 3*a*. Alternatively, this circular notch could be made at the convex surface 3*b*.

This decrease in thickness of the base of the sectors 11 could be combined with a decrease in thickness of the ends of the sectors, provided by a land (as shown in FIG. 4) or by a spherical part having a larger radius of curvature at a median part of the convex face (as shown in FIG. 3) or a lower radius of curvature at a median part of the concave face.

FIG. 5 shows a mounting of the cap with its convex part 3*b* oriented towards the inside INT of the turret. It would be possible to provide an opposite mounting of the cap, that is, with the convex part 3*b* oriented towards the outside EXT of the turret. Even with such an opposite mounting, the shape of the shell with a spherical profile ensures that the cap returns in an obturated position after it has been deformed by a cartridge, and thus ensures a good sealing. However, such a variant has the disadvantage that the over-pressure within the turret causes the sectors to be pushed in the direction in which they open. It is thus necessary to provide a cap having a larger thickness so as to stiffen the sectors and restrict the pressure leaks. However, it will result in an increase in the friction force of the cartridges on the sectors of the cap.

FIGS. 7*a*, 7*b* and 8 show a cap according to a fifth embodiment, the cap being more particularly designed to be mounted on a turret with its convex part 3*b* oriented towards the outside EXT of the turret.

As in the preceding embodiments, the cap 1 comprises a circular base 2 intended to allow it to be attached at the duct, and a shell 3 having a spherical dome profile comprising a concave face and a convex face.

Here, the dome 3 is not hemispherical but extends at an angle α of about 120°. The dome has a reinforced thickness to ensure, as mentioned above, stiffening of the sectors 11 and thus to restrict the pressure leaks.

The shell 3 is divided into four sectors by slots 12 which are evenly distributed angularly, the sectors 11 being contiguous pairwise. This embodiment differs from the preceding ones in that the slots 12 are not made along diametrical planes of the cap 1 but each slot 12 is inclined with respect to a diametrical plane.

FIG. 7*b* shows, with continuous lines 12*a*, the outer edge of the slots 12 as visible at the convex face 3*b* of the cap. The dotted lines 12*b* show the inner edge of the slots as visible at the concave face 3*a* of the cap 3.

The dotted lines 12*c* show the leg of each slot 12 which extends between the concave face 3*a* and the convex face 3*b*. It can thus be noted that the leg (or base) of each slot 12 is inclined at an angle γ with respect to a diametrical plane (shown by the trace 12*a* of an outer edge of each slot).

It can also be noted that this inclination is gradually reduced between the base 12*c* of the slot and its end at the vicinity of the center C of the cap 1 (the center being located at the axis 16 of the cap).

Indeed, the slot 12 is diametrically oriented at the vicinity of the center C of the cap to ensure the contact of the plurality of sectors 11. The axis 16 is an area of the cap 1 at which all sectors 11 are contiguous.

FIG. 9 is a sectional view of the cap 1 along the plane whose trace DD is visible in FIG. 7*a*. FIG. 9 allows to view an intermediary inclination of the different slots 12. Especially, it allows to view that the inclination of the slots 12 makes it possible to ensure a pairwise and partial covering of the contiguous sectors 11. Such an arrangement improves the sealing of the cap 1 when it is disposed with its convexity oriented towards the outside. Indeed, the over-pressure within the turret has an effect facilitating the opening of the sectors 11.

With such an arrangement, the sectors 11 remain in contact at the beginning of their deformation instead of opening up. Each sector thus comprises beveled profiles 11*a* which abut on the adjacent sector and ensure a gas-proofness.

The slots 12 having a variable inclination will be made by laser cutting on a non-split cap. The variation of the inclination of the slot will result in a variation of the inclination of the laser head that is associated with its advance movement along the axis 16 of the cap.

FIGS. 10 and 11 show the mounting of such cap 1 at a duct 4 for ejecting cartridges 5 from a turret 6. The turret is not shown in detail, FIG. 10 showing only one part of the duct 4.

The ejecting duct 4 makes it possible to move the cartridges 5 from an area (INT) inside the turret to the outside (EXT). Here again, the weapon system (not shown) is located on the inside INT side and pushes the cartridges 5 in the duct 4. The cartridges 5 are ejected along the direction D that is parallel to the axis 7 of the duct 4.

Here again, the circular base 2 of the cap 1 abuts against a shoulder 8 surrounding the duct 4 and is immobilized by a nut 9 screwed in a tapped hole 10. Other embodiments are possible, such as the embodiment previously described as a comment for FIG. 5. The cap 1 is made of a flexible material such as rubber.

As it can be seen in FIG. 11, the cartridge 5, which has an ejection speed of about several meters per second, applies a force to the interior of the concave part 3*a* of the cap 3. It spreads the sectors 11 to the exterior. The cartridge 5 can thus pass through the cap 3 and is ejected to the outside EXT of the turret 6.

Here again, it is necessary, in order to make the passage of the cartridge 5 through the cap 3 possible, that the slots 12 which delimit the sectors 11 have a length sufficient to allow the passage of the cartridge 5.

In particular, it is necessary that the diameter Δ of the circle 13 (FIG. 7*b*), which is the trace of the plane perpendicular to the axis 16 of the cap and passing through the ends of the slots 12, be greater than the diameter of the cartridge 5. Advantageously, the diameter Δ will be greater by about 70% than the diameter of the cartridge.

The elasticity of the cap 1, associated with its spherical shape, causes the sectors 11 to return to their initial position (FIG. 7*a*) after the passage of the cartridge 5. The sealing is thus ensured after the passage of the cartridge 5.

As for the preceding embodiments, the stiffness of the sectors 11 could be adjusted by changing the number of sectors. For example, three diametrical slots 12, which will delimit six sectors, could be provided.

As a variant, it is also possible to provide caps similar to those shown in FIG. 1*a*, 1*b*, 2*a*, 2*b*, 3 or 4, but for which the shell is not formed by a hemispherical dome but is formed by a simple spherical dome. Such arrangement makes it possible to provide caps whose axial bulk is reduced.

Figure 12A:
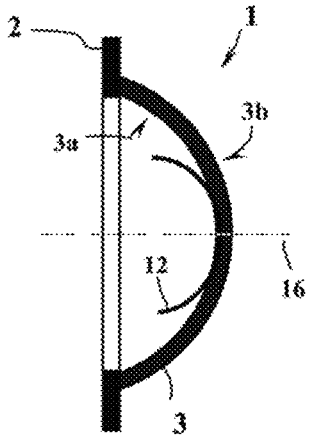
Figure 12B:
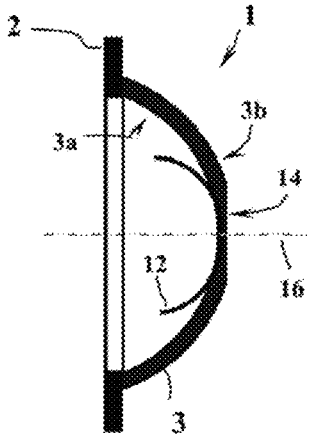
Figure 12C:
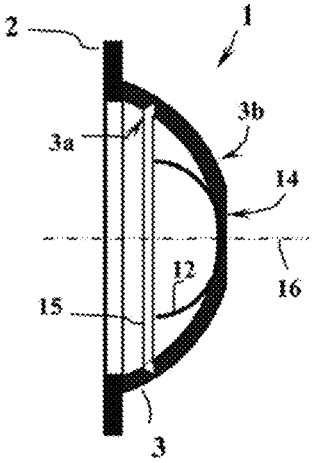
Figure 12D:
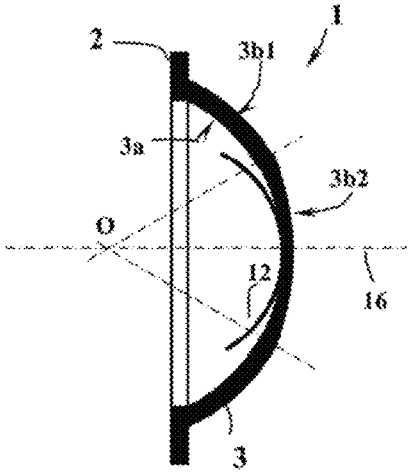

For illustrative purposes, FIGS. 12*a*-12*d* show different variants. FIG. 12*a* is similar to FIG. 1*a*, but with a non-hemispherical cap. FIG. 12*b* is similar to FIG. 2*a*, but with a non-hemispherical cap. FIG. 12*c* is similar to FIG. 4, but with a non-hemispherical cap. Finally, FIG. 12*d* is similar to FIG. 3, but with a non-hemispherical cap.

The invention claimed is:

1. A cap intended to obturate a duct for ejecting cartridges from a turret, the cap comprising:

a circular base intended to allow the cap to be attached at the duct, and a shell having a spherical dome profile including a concave face and a convex face, the shell alone being divided into at least four sectors by slots which are evenly distributed angularly, the shell being cut along the slots, the sectors being contiguous pairwise and having a base of the sectors that is located on the shell, the cap being made of a flexible material, a natural elasticity of the flexible material ensuring that the cap is held in a closed position and a shape of the shell with the spherical dome profile ensuring that the cap returns in an obturated position after the cap has been deformed by a cartridge, wherein each slot is inclined with respect to a diametrical plane, the inclination being variable between a leg of the slot and an end of the slot at the vicinity of an axis of the cap, the slot being diametrically oriented at the vicinity of the axis of the cap so as to ensure the contact of the plural sectors, the inclination of the slots ensuring a partial covering of the contiguous sectors.

2. The cap according to claim 1, wherein the shell includes a thinner area at the vicinity of an axial part of the shell.

3. The cap according to claim 2, wherein the thinner area results from the presence of a land.

4. The cap according to claim 2, wherein the thinner area results from the presence of a different radius of curvature among a peripheral part and a median part at the concave face of the shell.

5. The cap according to claim 2, wherein the thinner area results from the presence of a different radius of curvature among a peripheral part and a median part at the convex face of the shell.

6. The cap according to claim 2, wherein the thinner area results from the presence of a different radius of curvature among a peripheral part and a median part at the concave face and at the convex face of the shell.

7. The cap according to claim 1, wherein the shell comprises a thickness-decreasing circular area which is located at the vicinity of a base of the sectors.

8. The cap according to claim 1, wherein the shell has a substantially hemispherical shape.

9. The cap according to claim 1, wherein the cap is made of rubber.

10. A turret comprising a duct for ejecting cartridges between an area inside the turret and the outside, wherein the duct includes at least one cap according to claim 1, through which cap the cartridges pass when they are ejected.

11. The turret according to claim 10, wherein the cap is oriented with a convex face of the cap towards the inside area.

12. The turret according to claim 10, wherein the cap is oriented with a convex face of the cap towards the exterior.

13. A cap intended to obturate a duct for ejecting cartridges from a turret, the cap comprising a circular base intended to allow the cap to be attached at the duct, and a shell having a spherical dome profile including a concave face and a convex face, the shell being divided into at least four sectors by slots which are evenly distributed angularly, the sectors being contiguous pairwise, wherein each slot is inclined with respect to a diametrical plane, the inclination being variable between a leg of the slot and an end of the slot at the vicinity of an axis of the cap, the slot being diametrically oriented at the vicinity of the axis of the cap so as to ensure the contact of the plural sectors, the inclination of the slots ensuring a partial covering of the contiguous sectors.

* * * * *